US006103162A

United States Patent [19]

Frigge et al.

[11] Patent Number: 6,103,162

[45] Date of Patent: Aug. 15, 2000

[54] PROCESS FOR PRODUCING CELLULOSE FIBRES

[75] Inventors: Konrad Frigge, Potsdam; Hans-Peter Fink, Teltow; Peter Weigel, Kleinmachnow; Ernst Walenta; Helmut Remde, both of Potsdam, all of Germany

[73] Assignee: Fraunhofer-Gesellschaftzur Forderung der Angewandten Forschung e.V., Munich, Germany

[21] Appl. No.: 09/091,679

[22] PCT Filed: Nov. 13, 1996

[86] PCT No.: PCT/DE96/02190

§ 371 Date: Dec. 14, 1998

§ 102(e) Date: Dec. 14, 1998

[87] PCT Pub. No.: WO97/25462

PCT Pub. Date: Jul. 17, 1997

[30] Foreign Application Priority Data

Jan. 9, 1996 [DE] Germany ..... 196 00 572

[51] Int. Cl.[7] ..... D01D 10/06; D01F 2/02

[52] U.S. Cl. ..... 264/187; 264/211.15; 264/233

[58] Field of Search ..... 264/187, 211.15, 264/233; 106/200.3; 428/364

[56] References Cited

U.S. PATENT DOCUMENTS 5,618,483 4/1997 Weigel et al. ..... 264/187

FOREIGN PATENT DOCUMENTS

4420304C1 9/1995 Germany .
WO92/14871 9/1992 WIPO .

OTHER PUBLICATIONS

Lenz, J. et al. "Properties and Structure of Lyocell and Viscose—Type Fibres in the Swollen State", Lenzinger Berichte, No. 9 (Sep. 1994), pp. 19–25.

Weigel, P. et al. "Strukturbildung Von Cellulosefasern Aus Aminoxidlosungen". Lenzinger Berichte, No. 9 (Sep. 1994), pp. 31–36.

*Primary Examiner*—Leo B. Tentoni
*Attorney, Agent, or Firm*—Locke Reynolds LLP

[57] ABSTRACT

The invention relates to a process for producing flexible cellulose fibres by spinning solutions of the cellulose through spinnerets over an air layer in an amine oxide-containing aqueous and/or alcoholic regenerating bath followed by drying, in which the damp threads from the spinneret are taken before drying through at least one post-treatment bath containing water and water-miscible alkanols, diols, triols or mixtures thereof, and a washing bath containing water, an alkanol, a diol or a triol.

19 Claims, No Drawings

PROCESS FOR PRODUCING CELLULOSE FIBRES

BACKGROUND OF THE INVENTION

The invention relates to a method of manufacturing cellulose fibres with reduced orientation and a reduced modulus, and to fibres produced according to this method.

Due to high investment costs, and in particular due to the high degree of stress on the environment, there is a considerable interest in finding alternatives to the viscose process, according to which at present the majority of cellulose regenerate fibres are manufactured. Among the most promising methods is the spinning of solutions of cellulose in amine oxides, preferably in N-methyl-morpholine-N-oxide (NMMNO), not least because in this way the complex path via derivatising of the cellulose is avoided. It is known from DE 28 30 685 and 20 DD 142 898 as well as from EP 0 490 870, that cellulose is soluble in a NMMNO water system, and can be processed to produce textile fibres by spinning in a mostly aqueous NMMNO solution.

Although the NMMNO process is already used on a large industrial scale, and the fibres produced thereby have proved successful for some textile applications, the latter reveal a series of differences in comparison to the fibres produced by the viscose process, and therefore are not usable in the conventional way in the textile field; among other things they reveal brittleness and a tendency to fibrillation in the wet condition. In addition, the values achieved for tensile stretch are unsatisfactory. A disadvantage is also seen in the fact that the range of variation of the physical textile characteristics is restricted when the manufacturing conditions are altered.

For the fibres produced according to the NMMNO process, in comparison to viscose fibres, high strengths and moduli are characteristic. Thus the tear strengths generally lie in a approximate range of about 20 to 50 cN/tex, and the initial moduli in a range of over 1500 cN/tex. This means that the strengths are highly satisfactory, and are often higher than necessary. On the other hand, however, the high modulus as a rule is caused by a high orientation of the fibres, and the high orientation is decisively responsible for a high tendency of the fibres to fibrillation. This high tendency to fibrillation however has an unfavourable effect for many applications of the fibres in the textile field.

One possibility of reducing the modulus to a limited degree and thus to reduce the tendency of the fibres to fibrillation, resides, instead of the normally-used spinning bath of an aqueous NMMNO solution, in using a solution of NMMNO in isopropanol or amylalcohol (SU 1 224 362) or to add specific hydrophilic additives (DE 95 104 358) both to the spinning solution and to the spinning bath. The slight reduction in strength resulting can be tolerated, as the fibres still have strengths corresponding to those of viscose fibres. In all, these methods however still leave something to be desired as regards the brittleness of the fibre and as regards the possibility of controlling the physical textile characteristics of the fibres by changing the manufacturing conditions.

Thus it remains a central problem to produce flexible cellulose fibres with a low tendency to fibrillation from NMMNO solutions, and to influence the spinning process in such a way that fibres can be produced thereby which cover the entire range of application of textile viscose fibres.

Proceeding from this point, it is the object of the present invention to provide a method for manufacturing flexible cellulose fibres with reduced brittleness and tendency to fibrillation.

SUMMARY OF THE INVENTION

Thus it is proposed according to the invention, in order to manufacture flexible cellulose fibres by spinning solutions of cellulose through spinnerets across an air gap into a spinning bath containing amine oxide, to pass the threads, moist from spinning, through at least one subsequent treatment bath and at least one wash bath before drying. Surprisingly, it has become apparent that, by means of this alteration as described above of the amine oxide process which is known per se, a clear reduction in brittleness and in tendency to fibrillation of the fibres manufactured by this process can be achieved. The initial moduli of the fibres in this case even reveal values of less than 1500 cN/tex and the degree of orientation of the amorphous areas of the fibres, compared to fibres previously manufactured from amine oxide solutions, is clearly reduced.

It has further become apparent that the degree of orientation, and even both of the crystalline and of the amorphous areas, can again be clearly influenced by tension and/or stretching during drying of the fibres. The method according to the invention thus, by means of appropriate selection of the subsequent treatment baths and of the wash baths, and by alteration in the stress or stretching during drying, enables the orientation of the amorphous and of the crystalline areas to be adjusted in a controlled manner. Therefore the method according to the invention enables the properties to be varied within relatively wide ranges, even in the case of cellulose fibres manufactured from amine oxide solutions.

In this case the method according to the invention is carried out in such a way that, as is known per se from prior art, the procedure starts from spinning of solutions of the cellulose in amine oxides, preferably in N-methyl-morpholine-N-oxide (NMMNO).

The particular properties of the fibres manufactured according to the amine oxide process are characterised by special structural properties; a more compact precipitation structure with increased crystallinity and chain orientation as well as altered crystallite form is to be noted in comparison to textile viscose fibres. In particular it becomes apparent that with increasing orientation, the modulus and the tendency to fibrillation increase. It is also known that swelling in water with all fibre types from regenerate cellulose (modal fibres, viscose fibres, polynosic fibres) leads to a reduction in strength, crystallinity and orientation. This effect is further reinforced, with the exception of the effect on orientation, when swelling is carried out in diluted soda lye. This applies also to fibres spun from NMMNO solution. However, the named structural parameters always remain on a higher level than with the other fibres (J. Lenz, J. Schurz and D. Eichinger, Lenzinger Berichte 9/94, page 19, Lenz, Schurz and Wrentschur, Colloid & Polymer Science 271, page 460 (1993). The same authors were also able to show that not only the orientation of the crystalline areas as a rule determined in X-ray tests, has an influence on the fibre properties, but also that in particular the orientation of the amorphous area which can be calculated in "Hermans"(in "Physics and Chemistry of Cellulose Fibres", Elsevier Publishing Company, New York, 1949) from the overall degree of orientation determined by double refraction and from crystal orientation and degree of crystallinity, both determined by means of X-ray tests, quite substantially determines the strength and the modulus of the fibres.

It could therefore not be foreseen by the person skilled in the art that the process measures proposed according to the invention, i.e. passage of the fibres moist from spinning through a subsequent treatment bath and a wash bath, would lead to a reduction in the initial moduli of less than 1500 cN/tex, and that the degree of orientation of the amorphous areas of the fibres in comparison to fibres previously manufactured from amine oxide solution is clearly reduced. According to the invention at least one subsequent treatment bath is used which contains water with water-miscible alkanols, diols and triols. In this case it is preferred if alkali is added to this first subsequent treatment bath. A mixture of alkanols, preferably of ethanol and soda lye, has proved particularly advantageous. In this case the subsequent treatment bath preferably consists of ethanol and 1 to 30%, preferably 8 to 20% soda lye. A subsequent wash bath is necessary in order to wash out components of the first subsequent treatment bath which cannot be removed by drying of the threads (e.g. soda lye). However, it appears, surprisingly, that the composition of this wash bath also influences the properties of the threads. Thus the wash bath preferably contains water, an alkanol, a diol or a triol or a mixture thereof. It is particularly preferred if the wash bath contains ethanol. Thus the orientation of the amorphous areas and the moduli of the threads is considerably lower if after treatment in an ethanol/soda lye bath as a wash bath, ethanol instead of water is used, whilst the orientation of the crystalline areas is practically identical after both types of treatment.

It was further ascertained that the degree of orientation, in fact both of the crystalline and of the amorphous areas, can be clearly influenced again by tension and/or stretching during drying of the fibres. The tension in this case can come to between 0 and 60%, preferably between 0 and 40%.

The invention also relates to the fibres manufactured by the method described above. The fibres according to the invention are particularly characterised in that, in comparison to the previous fibres manufactured from amine oxide solution, they have a reduced degree of orientation of the amorphous proportion and a lowered modulus.

ILLUSTRATIVE EXAMPLES OF THE INVENTION

The invention is explained in more detail by the following examples:

Example 1

A solution consisting of 9% cellulose, 79% NMMNO and 12% water is spun by means of an extruder through a 40-aperture nozzle with an aperture diameter of 0.1 mm into an aqueous spinning bath. The undried fibres are then partly subjected to a subsequent treatment in a special bath, thereafter washed and dried without tension.

TABLE 1.1

| | Subsequent Treatment of Samples | |
|---|---|---|
| | Subs. Treatment Bath | Wash Bath |
| Sample a | — | water |
| Sample b | — | ethanol |
| Sample c | ethanol/NaOH | water |
| Sample d | ethanol/NaOH | ethanol |

TABLE 1.2

| | Orientation and Mechanical Properties of Samples | | | |
|---|---|---|---|---|
| | $f_a$ | $f_c$ | Module [cN/tex] | Stretch at Tear [%] |
| Sample a | 0.653 | 0.925 | 2090 | 8.1 |
| Sample b | 0.502 | 0.935 | 1810 | 12.6 |
| Sample c | 0.347 | 0.945 | 1870 | 11.4 |
| Sample d | 0.230 | 0.927 | 955 | 11.3 |

$f_a$ and $f_c$ are the orientation factors for the amorphous or crystalline proportion in "Hermans" (in "Physics and Chemistry of Cellulose Fibres", Elsevier Publishing Company, New York, 1949). They each come to 1 for ideal orientation and 0 for ideal anisotropy.

Example 2

As Example 1, but with a tension during drying of 20% of the wet strength.

TABLE 2.1

| | Subsequent Treatment of Samples | |
|---|---|---|
| | Subs. Treatment Bath | Wash Bath |
| Sample e | — | water |
| Sample f | ethanol/NaOH | ethanol |

TABLE 2.2

| | Orientation and Mechanical Properties of Samples | | | |
|---|---|---|---|---|
| | $f_a$ | $f_c$ | Module [cN/tex] | Stretch at Tear [%] |
| Sample e | 0.707 | 0.944 | 2320 | 8.2 |
| Sample f | 0.331 | 0.936 | 1350 | 10.2 |

What is claimed is:

1. A method of manufacturing flexible cellulose fibres comprising producing fibres by spinning solutions of cellulose through spinnerets across an air gap into a precipitation bath, the precipitation bath comprising amine oxide and being at least one of aqueous and alcoholic;

passing the fibres being wet from spinning through at least one subsequent treatment bath comprising water and with water miscible alkanols, diols or triols or mixtures thereof;

passing the wet fibres through at least one wash bath comprising at least one of water, an alkanol, a diol and a triol; and drying the fibres.

2. The method according to claim 1, wherein the subsequent treatment bath is alkaline.

3. The method according to claim 1, wherein the subsequent treatment bath consists of a mixture of alkanols and soda lye.

4. The method according to claim 3, wherein the subsequent treatment bath consists of ethanol and 1 to 30% of soda lye.

5. The method according to claim 1, wherein the wash bath comprises an alkanol.

6. The method according to claim 5, wherein that the wash bath comprises ethanol.

7. The method according to claim 1, wherein the fibres are exposed to tensile stress during drying.

8. The method according to claim 7, wherein the tensile stress lies between 0 and 60% of a wet strength.

9. The method according to claim 2, wherein the subsequent treatment bath consists of a mixture of alkanols and soda lye.

10. The method according to claim 2, wherein the wash bath comprises an alkanol.

11. The method according to claim 3, wherein the wash bath comprises an alkanol.

12. The method according to claim 4, wherein the wash bath comprises an alkanol.

13. The method of claim 10, wherein that the wash bath comprises ethanol.

14. The method according to claim 2, wherein the fibres are exposed to tensile stress during drying.

15. The method according to claim 3, wherein the fibres are exposed to tensile stress during drying.

16. The method according to claim 5, wherein the fibres are exposed to tensile stress during drying.

17. The method according to claim 14, wherein the tensile stress lies between 0 and 60% of a wet strength.

18. The method according to claim 15, wherein the tensile stress lies between 0 and 60% of a wet strength.

19. The method according to claim 1, wherein initial moduli of the fibres have values of less than 1500 CN/tex.

* * * * *